US005195571A

United States Patent [19]

Morgan et al.

[11] Patent Number: 5,195,571

[45] Date of Patent: Mar. 23, 1993

[54] METHOD OF DIE CAST MOLDING METAL TO FIBER REINFORCED FIBER PLASTIC

[75] Inventors: Mark R. Morgan, Dayton; Johnny R. Gentry, Kettering, both of Ohio

[73] Assignee: General Motors Corporation, Detroit, Mich.

[21] Appl. No.: 660,202

[22] Filed: Feb. 25, 1991

[51] Int. Cl.[5] ..... B22D 19/04; B22D 19/14

[52] U.S. Cl. ..... 164/98; 156/155; 164/112; 164/106

[58] Field of Search ..... 164/122, 97, 98, 112, 164/47, 69.1, 91, 106, 107; 156/242, 155

[56] References Cited

U.S. PATENT DOCUMENTS

| | | | |
|---|---|---|---|
| 4,337,817 | 7/1982 | Komatsu | 164/120 |
| 4,648,921 | 3/1987 | Nutter | 156/242 |
| 4,813,590 | 3/1989 | Deakin | 228/120 |
| 4,990,207 | 2/1991 | Sakai | 156/242 |

FOREIGN PATENT DOCUMENTS

| | | | |
|---|---|---|---|
| 59-93548 | 5/1984 | Japan | 164/98 |
| 60-110830 | 6/1985 | Japan | 164/97 |
| 60-141362 | 7/1985 | Japan | 164/97 |
| 60-184653 | 9/1985 | Japan | 164/97 |
| 62-3862 | 1/1987 | Japan | 164/97 |
| 63-90350 | 4/1988 | Japan | 164/97 |
| 1-192858 | 8/1989 | Japan | 164/97 |
| 2225743 | 6/1990 | United Kingdom | 164/97 |

*Primary Examiner*—Richard K. Seidel
*Assistant Examiner*—Rex E. Pelto
*Attorney, Agent, or Firm*—Patrick M. Griffin

[57] ABSTRACT

Molten metal is die cast directly to and around a surface of a fiber reinforced plastic part in such a way as to actually take advantage of the thermal decomposition of the part resin caused by the hot metal. The molten metal is introduced to the surface and cooled just rapidly enough to allow a controlled, limited resin decomposition to occur at the top surface. Molten metal then flows in and around the exposed fibers, creating a secure interlock.

3 Claims, 4 Drawing Sheets

METHOD OF DIE CAST MOLDING METAL TO FIBER REINFORCED FIBER PLASTIC

This invention relates to die cast molding in general, and specifically to a method of die cast molding a metal member directly onto a sensitive fiber reinforced plastic body.

BACKGROUND OF THE INVENTION

Fiber reinforced plastic, typically referred to as FRP, may find increasing usage in the automotive industry, despite its higher cost, because of its high strength to weight ratios. An example is windshield wiper arms, which are traditionally metal components. As windshields are sloped back ever farther for aerodynamic efficiency, their wiper arms grow ever longer and heavier. The stress created by the extra weight at wiper reversal could require heavier and more expensive wiper motors and linkages, making a lighter FRP arm potentially cost effective. One problem with substituting FRP for metal in any automotive component is the fact that it is difficult or impossible to form it into shapes that are convoluted or discontinuous. Thus, it may serve well as a drive shaft, which is an elongated tube of constant cross section, but not as a transmission case, with its labyrinthine internal passages.

Another limitation is that many automotive components must be attached directly to another metal component at some point, which may require that the FRP component be provided with a localized metal fastening member. For example, an FRP drive shaft must have a metal connector at each end for attachment to the rest of the drive line. It is difficult to successfully and securely mate FRP directly to metal, especially when the attachment point will be subject to heavy loading and stress. Many patents are directed just to the problem of joining metal end pieces to FRP drive shafts, most of which involve various adhesives, rivets, splines or combinations thereof.

The designer of an FRP wiper arm would face both problems noted above. The main body of a wiper arm is basically a rod or beam with a fairly constant cross section and smooth exterior surface, presenting no particular protrusions or discontinuities. This is a basic shape that would lend itself well to FRP manufacture. A matrix of full length reinforcing glass fibers soaked with a conventional thermosetting resin is laid out in a mold with the desired beam shape, and then heat cured. However, each end of the beam must be connected to other structures, one to the wiper blade and one to the knurled wiper drive post. The end connection to the wiper post, especially, requires a complex shape and is subject to high stresses that are much better served by a metal to metal connection. Die casting a metal drive post connector directly to the end of an FRP arm would be preferable, in terms of time, cost and strength, to attaching a separate connector by adhesive or mechanical means. However, the thermoset resin that binds the fibers together decomposes badly at the melting temperatures of suitable metals, such as aluminum alloy. Tests that subjected FRP to molten metal for times comparable to the cycle times involved in standard die casting operations found such severe thermal decomposition of the resin as to conclude that the process would not be feasible.

SUMMARY OF THE INVENTION

The invention nonetheless provides a workable process for making a structural part in which a metal member is die cast directly onto a fiber reinforced plastic body. The thermal decomposition of the binding resin that results is actually controlled and used to advantage to improve the bond.

First, an FRP body is provided that has a relatively high content of full length glass reinforcing fibers, which are highly heat resistant. As disclosed, the body is a short beam of generally rectangular and constant cross section, with a relatively smooth exterior surface. The fibers are bound together with a thermosetting resin which, as discussed above, is not nearly so heat resistant.

Next, a chamber is provided that matches the desired shape of the metal member. The chamber is created by mating cavities in a pair of steel dies which inherently create a large heat sink mass, and which are also actively water cooled. The end of the body is centrally supported within the chamber with its exterior surface close to the interior surface of the cavities. The die surface thereby creates a chamber surrounding the exterior surface of the body that is substantially symmetrical and uniform in thickness.

Next, a molten aluminum alloy is provided, which has a temperature higher than the resin can withstand without experiencing decomposition, but low enough that it will not affect the fibers. The molten alloy is introduced into the chamber so as to completely fill it. As such, the molten alloy makes intimate contact both with the body and the dies, creating an inner jacket or interface at the body surface and a surrounding outer jacket or interface at the die cavity surface. The molten charge is retained for a time, during which it is cooled at the outer jacket by the mass of the dies and by circulating water. Heat flows radially outwardly from the molten metal rapidly and evenly, because of the symmetry of the chamber and the fact that it is unobstructed and relatively thin. The cooling serves to solidify or "freeze" the metal.

While rapid cooling is important, it is deliberately not made so rapid, nor is the retention time made so short, that all thermal decomposition of the resin is avoided. Instead, a limited, thin surface layer of resin is decomposed, exposing a thin region of glass fibers. The same factors that create the even cooling at the outer jacket create an even, controlled heating at the inner interface. Before cooling and solidification of the molten metal is complete, some runs in and around the exposed fibers, solidifying around them and interlocking to create a very secure interconnection. Finally, the completed structural component is ejected from the die. The metal member can then be attached to any other member in conventional fashion, and the FRP-metal joint can withstand substantial stress without failing.

It is, therefore, a general object of the invention to provide a method of directly die casting a metal member onto a heat sensitive fiber reinforced plastic body.

It is another object of the invention to provide such a method in which the thermal decomposition of the fiber binding resin that occurs when exposed to molten metal is used to advantage to increase the strength of the bond.

It is another object of the invention to provide such a method in which an outer cooling jacket surrounding a charge of molten metal is established to cool and solidify the metal in such a way that a controlled and limited thermal surface decomposition is established at the interface of the metal and the FRP body, exposing some of the fibers around which molten metal may flow and interlock.

DESCRIPTION OF THE PREFERRED EMBODIMENT

These and other objects and features of the invention will appear from the following written description, and from the drawings, in which.

Figure 1:
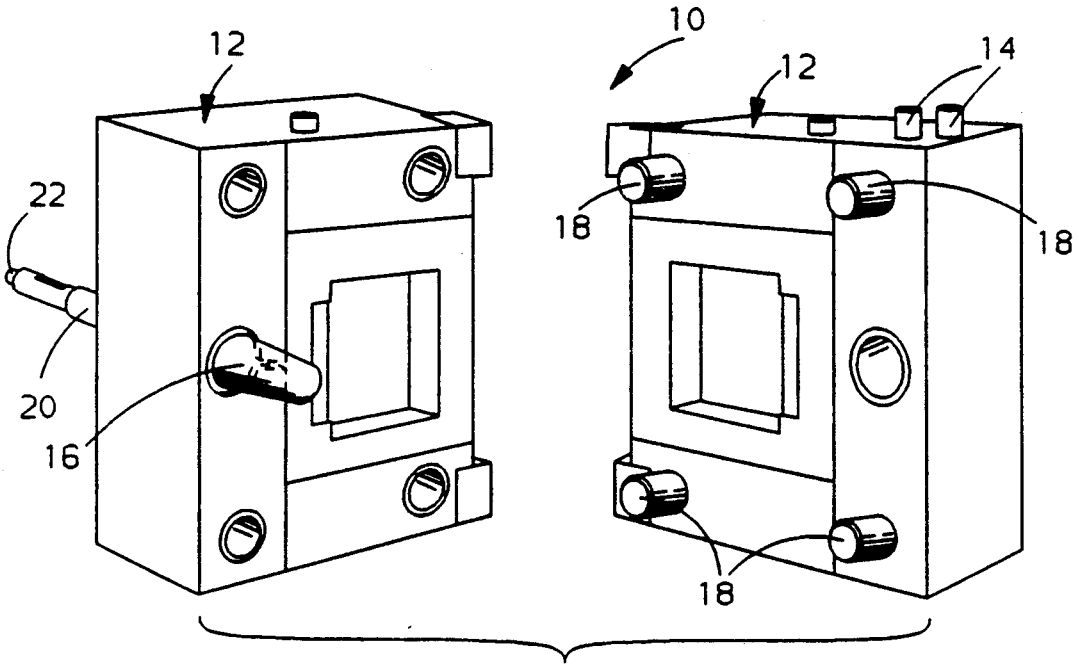
FIG. 1 is a perspective view of a pair of larger master dies that contain a pair of smaller unit dies.
Figure 2:
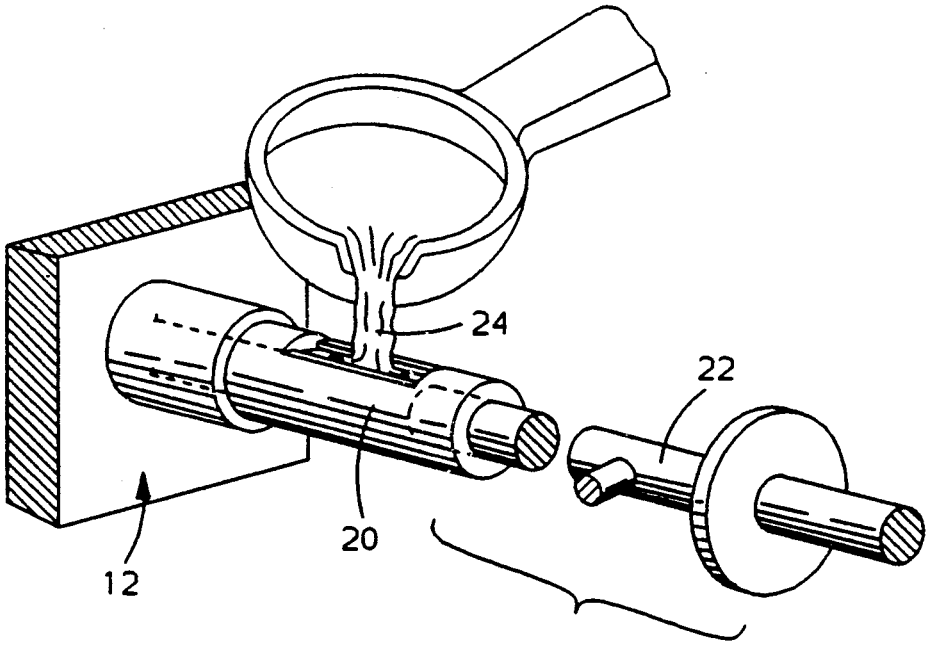
FIG. 2 is a perspective view of a shot chamber that feeds a charge of molten metal into the molding apparatus.
Figure 3:
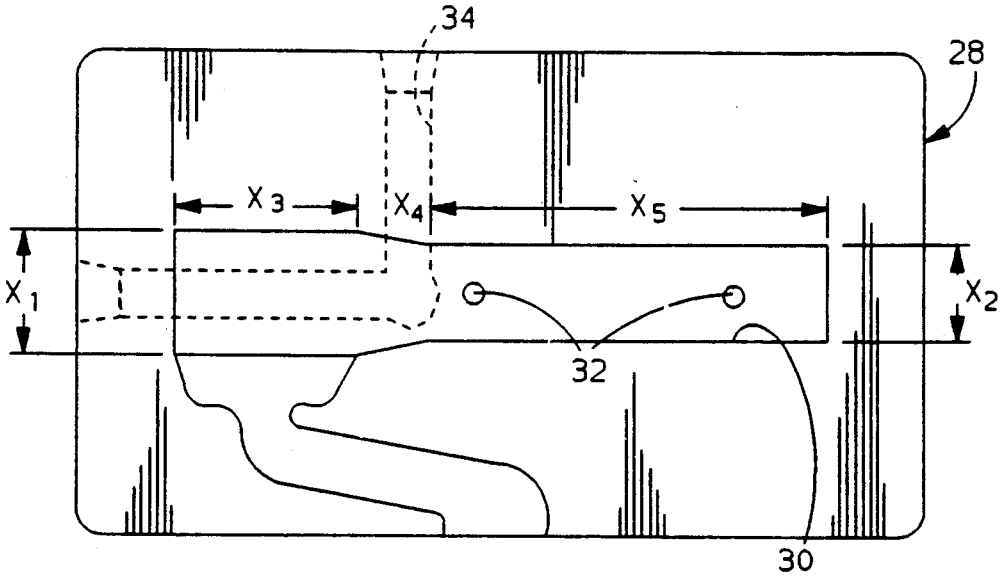
FIG. 3 is plan view of one of the unit dies showing the cavity machined therein.
Figure 4:
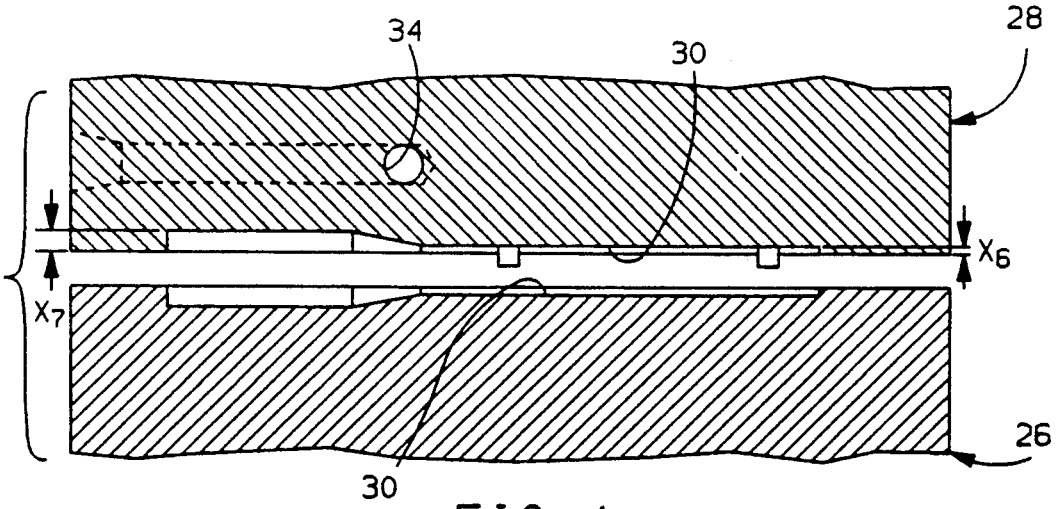
FIG. 4 is a side view of the two unit dies showing the plane in which they part.

Referring first to FIGS. 1, 2 and 4, the molding apparatus used is a horizontal cold chamber die casting machine, indicated generally at 10. Machine 10 is the type that has two main halves, called die holders or master dies 12. The master dies 12 are the foundation of the apparatus, supporting such features as cooling water lines 14, a sprue spreader 16, and leader pins 18. Supported opposite sprue spreader 16 is a shot chamber 20 and plunger 22 which are used to send a charge of molten metal 24 into the machine 10. More detail about metal 24 is given below. The master dies 12 support a pair of smaller unit dies, indicated generally at 26 and 28. It is the unit dies 26 and 28 that actually form the molded shape desired, allowing one machine like 10 to be used to make several different components. Each unit die 26 and 28 is a steel block, measuring nine by three by five inches, and therefore provides a significant heat sink mass in and of itself. In addition, each unit die 26 and 28 also makes intimate surface to surface contact with the interior of the master die 12 that supports it, which provides even more heat sink mass. Each unit die has a matching cavity 30 machined therein, the basic dimensions of which, $X_1$ through $X_7$ in inches, are 1.25 , 1.0, 2.0, 0.75, 4.25, 0.125, and 0.25 respectively. An enlarged end is formed in each cavity 30. Unit die 28 has a pair of locator pins 32 in its cavity 30 as well as a cooling water passage 34, but is identical to unit die 26 otherwise. In use, the unit dies 26 and 28 would be vertically opposed to one another, but are shown horizontal in FIG. 4 for ease of illustration. While machine 10 as disclosed is basically conventional, it should be understood that it would normally be used simply to cast a solid part of metal only.

Figure 6:
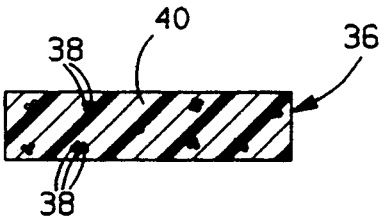
FIG. 6 is a cross section of the FRP body taken along the line 6—6 of FIG. 5.
Figure 5:
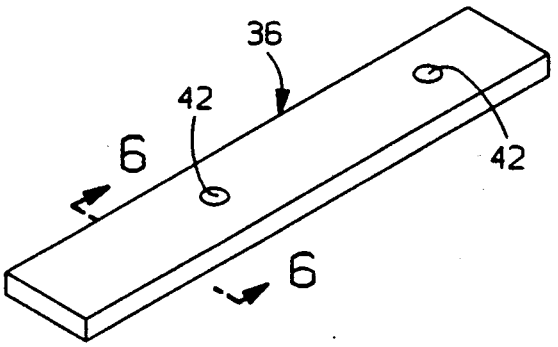
FIG. 5 is a perspective view of the FRP body.

Referring next to FIGS. 5 and 6, one of the two constituents of the structural component produced by the method of the invention is a compression molded FRP body, indicated generally at 36. Body 36 is basically a simple, short beam of constant rectangular cross section, with a six inch length, one inch width, and a quarter inch thickness. It is manufactured by first laying up a matrix of full length, glass reinforcing fibers 38 lengthwise within a mold that has the same shape as body 36. The content of fibers 38 is about 72%, by weight. Then, a thermosetting resin 40, which in this case is an amine cured bisphenol-A epoxy system, is injected around the bundle of fibers 38. The composite is then heat cured under pressure in the mold at 250 degrees F. for approximately ten minutes, and post cured out of the mold at 310 degrees F. for about fifteen minutes. Finally, a pair of holes 42 are drilled, matching the locator pins 32.

The temperature sensitivity and responsiveness of the fibers 38 and resin 40 as compared to metal 24 is important. Metal 24 is a standard 380 aluminum alloy, which is commonly used in die casting, and which has a melting point of 1220 degrees F. While the glass fibers 38 can withstand such a temperature, that is substantially beyond the temperature that the resin 40 could be expected to withstand without suffering very significant decomposition, even to the point of total structural failure of the part. In fact, tests showed that a sample like body 36, when dipped into molten aluminum for a time comparable to a normal molding cycle time, did suffer debilitating thermal decomposition. Thus, it was expected that an untreated, unprotected part like body 36 would never survive having aluminum die cast to it. Nevertheless, a method for doing so was developed, described next.

Figure 7:
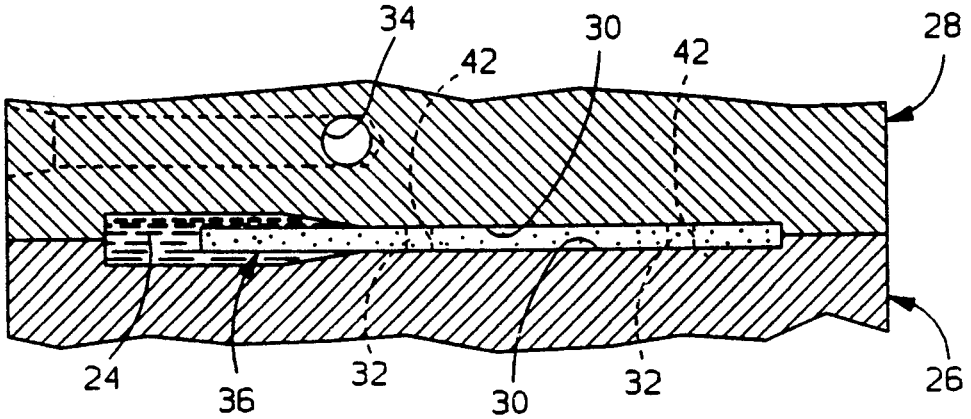
FIG. 7 is a side view of the two unit dies closed together with the FRP body supported between them and extending into the mated cavities.

Referring next to FIGS. 2 and 7, the basic steps of the die cast molding method are illustrated. First, body 36 is supported by inserting locator pins 32 through holes 42. Then, the unit dies 26 and 28 are closed. While most of the length of body 36 is closely contacted and pinched off by the inner surfaces of the cavities 30, the end of body 36 extends freely into the enlarged ends of the mated cavity 30. An unobstructed volume or chamber is thereby created that completely surrounds the end of body 36. The interior surfaces of the enlarged ends of the mated cavities 30 are close to the exterior surface of the end of body 36, so the surrounding chamber they create which is symmetrical, with a basic thickness of one eighth of an inch, as measured perpendicular to the surface of body 36. Next, a charge of molten metal 24 is forcibly pushed in from shot chamber 20 by plunger 22, and fills the chamber around the end of body 36 completely in less than a tenth of a second. Non illustrated vents and wells are in the unit dies provided to accommodate the displaced air as the molten metal 24 enters under pressure.

Figure 8:
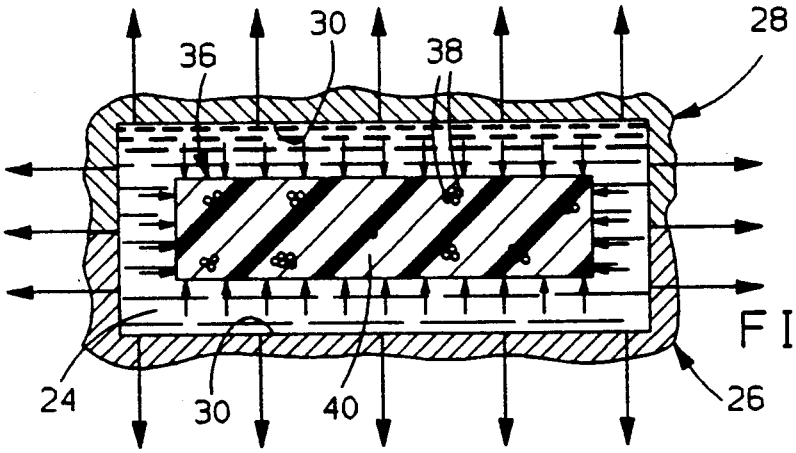
FIG. 8 is a cross section taken through the dies after the injection of metal around the end of the FRP body and schematically showing the heat flow therefrom.

As seen in FIG. 8, an inner jacket or envelope is established at the interface of metal 24 with the external surfaces of body 36, and a surrounding outer jacket or envelope at the interface between metal 24 and the inner surfaces of the cavities 30. A relatively rapid outer heat flow from metal 24 to the unit dies 26 and 28 is immediately established at the outer envelope, which is visually represented by the longer arrows. The radially outward heat flow from metal 24 results from the large heat sink mass of the unit dies 26 and 28 and the master dies 12, an effect that is aided by the circulation of cooling water through water lines 14 and water passage 34. Water is pumped through at a flow rate of approximately 20 gallons a minute. Heat flow from metal 24 is also kept rapid and even by the relative thinness of the filled volume around the ned of body 36, and by the symmetry of the volume described above. The unit dies 26 and 28 are kept closed for about ten seconds, after which time the metal 24 cools to about 500 degrees F. and solidifies. The steady state operation temperature of the unit dies has been measured to be about 350 degrees F.

Figure 9:
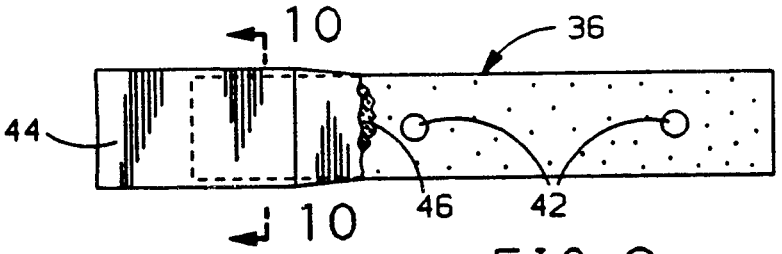
FIG. 9 is a plan view of the completed part, showing a flow of melted resin that has squeezed out of the FRP-metal interface.

Referring next to FIG. 9, the final result is illustrated. After ten seconds, the unit dies 26 and 28 are opened and the completed part, consisting of body 36 and now solidified metal end member 44, is ejected and water cooled to room temperature. After removal, a black substance is sometimes observed to ooze out and solidify in a small, shiny pool at the joint between the surface of body 36 and metal member 44, indicated at 46, which is further explained below. Clearly, the body 36 has not decomposed or burned to the point where it has eaten through or fallen off, but its response to heavy loading is more important to proof of production feasibility. In fact, the completed part is not used as an actual component, but as a tensile test specimen to indicate that feasibility. It is held by the holes 42 in a test machine and a measured pulling force applied to metal member 44. Tensile loads of approximately 1400 pounds have been achieved. Since a component like a wiper arm would have a body shaped much like body 36 and a metal end connection member similar to member 44, which could be later drilled, machined, splined or otherwise shaped. This is impressive evidence of production worth. Two phenomenon are thought to contribute to the success of the process and the strength metal to body bond. One is clearly the rapid and even cooling of the molten metal 24, which protects the body 36 from excessive damage. Even more important, however, is what happens at the inner envelope, described next.

Figure 10:
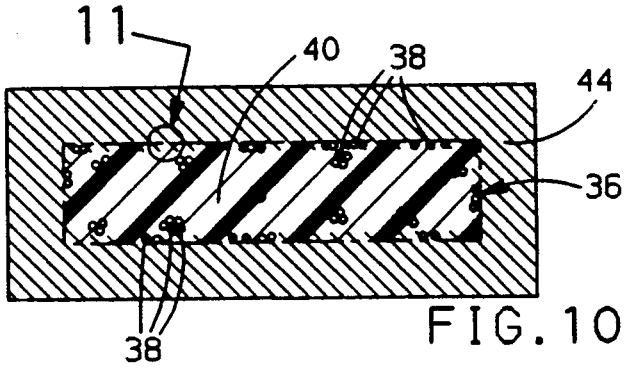
FIG. 10 is a cross sectional view taken along the line 10—10 of FIG. 9, showing schematically the interlock of the metal with the fibers exposed at the surface of the FRP body.
Figure 11:
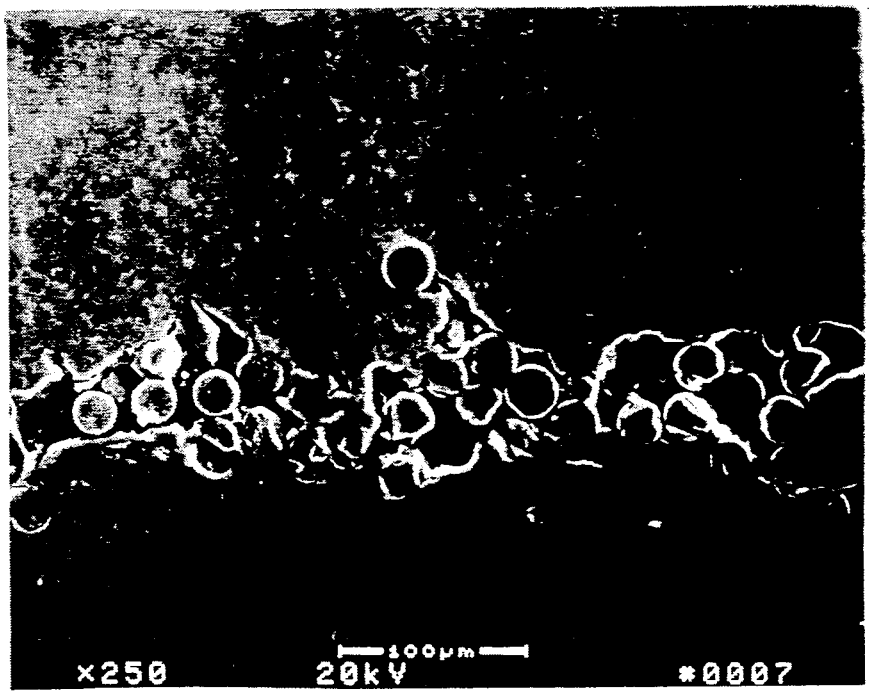
FIG. 11 is an actual photomicrograph taken with a scanning electron microscope at approximately 250× magnification, showing an enlarged circled portion of the interface of FIG. 10.

Referring next to FIGS. 8 through 11, the action at the interface between molten metal 24 and the exterior surface of the end of body 36 is illustrated. The heat flow out of molten metal 24 is not so rapid that no heat flows radially inwardly therefrom to the surface of body 36. Instead, a radial inward heat flow to the surface of body 36 is established, represented by the shorter arrows. Just as with the outward heat flow, the rate is kept relatively even by the symmetry of the surrounding volume. While the temperature at the metal-FRP surface interface has not been directly measured, it has been observed from laboratory tests that resin 40 begins to decompose at between seven and eight hundred degrees F. It appears that the temperature at the surface of body 36 must approach that temperature, because it is clear from two observed phenomenon that some of the resin 40 at the upper surface layer of body 36 does decompose, a phenomenon represented by the phantom line in FIG. 10. One observation is the solidified outflow 46. This is clearly melted or otherwise liquefied resin 40, at least in part, since it is not metal and the glass fibers 38 will not melt even at the melting temperature of the metal 24. More telling is what is observed by cutting, polishing and observing the interface under magnification, as seen in FIGS. 10 and 11. The resin 40 has clearly degraded over a layer varying from about 30 to 70 micrometers in thickness, exposing some of the fibers 38. The metal 24 has clearly flowed amongst and around the exposed fibers 38, creating a secure interlock and interconnection therewith.

While it is clear that it does occur in fact, the exact mechanism of the thermal degradation of resin 40 is not exactly understood. It apparently gasifies, and in some cases at least, condenses and liquifies again, witness pool 46. Clearly, the decomposition process is limited in effect and depth, as it does not structurally threaten the part. An important factor in the control and limitation of the level of thermal decomposition is the rapid and even cooling of the metal 24 so that not too much resin 40 is lost. Another controlling and limiting factor may well be the exposed layers of fibers 38 themselves acting as insulation against the heat, and the fiber content of body 36 is relatively high. Other control factors may be the exclusion of air by the close fill of the molten metal 24, or the pressure that it is under. It is very significant that the thermal decomposition process is limited and controlled, by whatever mechanism, as opposed to being prevented altogether. A logical approach, knowing that the molten metal 24 was far hotter than necessary to induce rapid thermal decomposition of the resin 40 would be to try to prevent it from occurring at all, or at least substantially, by more rapid cooling, or by deliberate heat insulation and protection of the outer surface of body 36 over that portion to be contacted by molten metal 24. In fact, this was tried with various thermal barrier materials, such as stainless steel flakes and silica, which were also test cast with a metal having a lower melting temperature. While thermal loss of resin was substantially prevented, the metal to FRP surface joint was not nearly so strong.

Variations of the process should be possible within the basic outlines disclosed. Most broadly conceived, the idea is to introduce molten metal directly to the surface of the FRP part, and then cooling and time limiting its contact sufficiently to expose a top layer of reinforcing fibers around which molten metal may flow and interlock with. As disclosed, the molten metal is introduced in surrounding relation to an external surface of an FRP part, but it could conceivably be poured directly into a concavity in the part, with no mold, and cooled by some other means. More could be done to tailor the characteristics of the FRP fibers and resin to the molten metal and vice versa so as to achieve the desired result, such as increasing the fiber content at the surface, or experimenting with different metals, temperatures, or even surface coatings that provide some, but not a complete, thermal barrier. For example, it is thought that the shrinkage of the cooling aluminum around the end of body 36 aids in creating the bond. Other metals might shrink even tighter. Each designer will undoubtedly experiment with different cooling rates, metal thicknesses and cycle times so as to achieve the optimum level of the resin degradation and metal interlock that has been discovered here. While the symmetry of the chamber surrounding the end of body 36 aids in even cooling, asymmetric shapes could be molded, as well. Judicious placement of cooling lines could be used to control the cooling rate. Therefore, it will be understood that it is not intended to limit the invention to just the embodiment disclosed.

The embodiments of the invention in which an exclusive property or privilege is claimed are defined as follows:

1. A method of manufacturing a structural component having a fiber reinforced plastic main body and a metal member on said body, comprising the steps of, providing said main body comprised of a matrix of substantially continuous reinforcing fibers having a heat resistance greater than the melting point of said metal, said fibers further being bound together by a resin that has significantly less resistance to heat decomposition than said fibers, introducing said metal in a molten state to a surface portion of said main body so as to establish a direct contact interface therewith, and, cooling said metal to a sufficient degree and for a sufficient time such that the molten metal solidifies to form said member while simultaneously decomposing sufficient resin at said direct interface interface to expose a layer of reinforcing fibers around which some molten metal may flow to interlock with said exposed fibers and thereby create a secure interconnection.

2. A method of molding a metal member directly onto the surface of a fiber reinforced plastic body of the type comprising a matrix of heat resistant reinforcing fibers bound together by a less heat resistant resin, comprising the steps of, supporting said body in a mold cavity having the desired shape of said metal member with a surface portion of said body exposed in said cavity, providing molten metal at a temperature sufficiently high to thermally decompose said resin but low enough to leave said fibers intact, introducing molten metal into said mold cavity so that it forms an interface both with said mold cavity and said body surface portion, and cooling said cavity to a sufficient degree and for a sufficient time such that the molten metal solidifies at the cavity interface while simultaneously decomposing sufficient resin at the body surface interface to expose a layer of reinforcing fibers around which some molten metal may flow around to interlock with said exposed fibers and thereby create a secure interconnection.

3. A method of molding metal directly onto an exterior surface portion of a fiber reinforced plastic body of the type comprising a matrix of heat resistnat reinforcing fibers bound together by a less heat resistant resin, comprising the steps of, supporting said plastic body with said exterior surface portion substantially unobstructed, enclosing said exterior surface portion with a heat sink mass having an interior surface proximate to said body exterior surface portion but spaced therefrom by a substantially constant amount so as to create a continuous and unobstructed chamber surrounding said exterior surface portion, providing a molten metal at a temperature sufficiently high to thermally decompose said resin but low enough to leave said fibers intact, filling said chamber with said molten metal so that it completely contacts both surfaces thereof, thereby drawing heat from said molten metal and away from said body exterior surface portion at a substantially even rate, retaining said molten metal in said chamber a sufficient time for said heat sink mass to cool and solidify said molten metal while said molten metal simultaneously decomposes sufficient resin at said body exterior surface interface to expose a layer of reinforcing fibers around which some molten metal may flow around to interlock with said exposed fibers and thereby create a secure interconnection.

* * * * *

UNITED STATES PATENT AND TRADEMARK OFFICE

CERTIFICATE OF CORRECTION

PATENT NO. : 5,195,571

DATED : March 23, 1993

INVENTOR(S) : Mark R. Morgan, Johnny R. Gentry and Jemei Chang

It is certified that error appears in the above-identified patent and that said Letters Patent is hereby corrected as shown below:

Title Page, at [75] add -- Jemei Chang, Sugar Land, Texas --.

Signed and Sealed this

Fifth Day of April, 1994

Bruce Lehman

*Attest:*

BRUCE LEHMAN

*Attesting Officer*

*Commissioner of Patents and Trademarks*